US011033933B2

(12) United States Patent
Rafferty

(10) Patent No.: US 11,033,933 B2
(45) Date of Patent: Jun. 15, 2021

(54) MOBILE AGGREGATE PROCESSING PLANT

(71) Applicant: Portafill International Limited, Omagh (GB)

(72) Inventor: Malachy James Rafferty, Omagh (GB)

(73) Assignee: Portafill International Limited, Omagh (GB)

( * ) Notice: Subject to any disclaimer, the term of this patent is extended or adjusted under 35 U.S.C. 154(b) by 175 days.

(21) Appl. No.: 16/293,852

(22) Filed: Mar. 6, 2019

(65) Prior Publication Data

US 2019/0283083 A1 Sep. 19, 2019

Related U.S. Application Data

(60) Provisional application No. 62/643,527, filed on Mar. 15, 2018.

(51) Int. Cl.

| | |
|---|---|
| ***B07B 1/28*** | (2006.01) |
| ***B07B 1/00*** | (2006.01) |
| ***B07B 13/16*** | (2006.01) |

(52) U.S. Cl.
CPC ..... *B07B 1/005* (2013.01); *B07B 13/16* (2013.01)

(58) Field of Classification Search
CPC ..... B07B 1/005; B07B 1/28; B07B 13/16
See application file for complete search history.

(56) References Cited

U.S. PATENT DOCUMENTS

| | | | | |
|---|---|---|---|---|
| 5,285,905 A * | 2/1994 | Laprade | ..... | B07B 15/00 209/241 |
| 5,577,618 A * | 11/1996 | Rafferty | ..... | B07B 1/005 209/244 |
| 6,405,874 B1 * | 6/2002 | Douglas | ..... | B02C 21/02 209/241 |
| 6,698,594 B2 | 3/2004 | Cohen et al. | | |
| 6,877,610 B2 * | 4/2005 | Boast | ..... | B02C 21/02 209/257 |
| 7,461,746 B1 * | 12/2008 | Egge | ..... | B02C 21/02 209/268 |

(Continued)

FOREIGN PATENT DOCUMENTS

| | | | | |
|---|---|---|---|---|
| DE | 1816165 A1 | 7/1969 | | |
| GB | 1189570 A * | 4/1970 | ..... | B07B 1/005 |
| GB | 1189570 A | 4/1970 | | |

OTHER PUBLICATIONS

Extended European Search Report for EP3409381, dated Dec. 18, 2018, 13 pages.

*Primary Examiner* — Joseph C Rodriguez
(74) *Attorney, Agent, or Firm* — Faegre Drinker Biddle & Reath LLP

(57) ABSTRACT

A mobile aggregate processing plant for screening aggregate material comprising a mobile chassis, a vibrating screening unit mounted on the mobile chassis and able to provide at least one aggregate discharge stream therethrough, and an underscreen conveyor located wholly or substantially beneath the vibrating screening unit to wholly or substantially receive said at least one aggregate discharge stream, wherein the underscreen conveyor is driveable in an uphill direction so as to be able to discharge the aggregate discharge stream at a height higher than receiving the aggregate discharge stream, relative to the mobile chassis.

14 Claims, 3 Drawing Sheets

(56) References Cited

U.S. PATENT DOCUMENTS

| | | | | |
|---|---|---|---|---|
| RE42,969 | E * | 11/2011 | McCloskey | B07B 1/16 209/241 |
| 9,085,015 | B2 * | 7/2015 | Schirm | B07B 1/46 |
| 9,694,363 | B2 * | 7/2017 | Salminen | B65G 41/002 |
| 2003/0173265 | A1 * | 9/2003 | Cohen | B07B 1/005 209/241 |
| 2005/0045052 | A1 | 3/2005 | Cohen et al. | |
| 2020/0061632 | A1 * | 2/2020 | Venturi | B02C 4/42 |

* cited by examiner

MOBILE AGGREGATE PROCESSING PLANT

RELATED APPLICATION

The present application is related to and claims priority from U.S. Provisional Application 62/643,527 filed on Mar. 15, 2018, the disclosure of which is incorporated herein by reference in its entirety.

FIELD OF THE INVENTION

The present invention relates to a mobile aggregate processing plant for screening aggregate material, generally to separate by 'screening' a mixed size or coarseness of an aggregate feed material into two or more discharge streams of different particle size.

BACKGROUND

Mobile aggregate processing plants for screening aggregate material are well known in the art. They generally comprise a vibrating screening unit, sometimes termed a 'screen box', having a series of heavy-duty screens with defined openings, such that an aggregate feed material can be separated by the moving screens into different sized discharge streams. Typically, there are one or more discharge streams at or near the end of the vibrating screening device of different particle sizes or coarseness, whilst that part of the aggregate material with a dimension less than the openings in the screens, is drawn by gravity down through the screen openings, and can be collected directly beneath the screening unit.

The discharge streams can be directed away from the plant by various suitable conveyors, generally being positioned in different directions, into suitable piles or into suitable containers or trucks, etc. Once feed material at one location is screened, the mobile aggregate processing plant can be relocated for processing a new feed of aggregate material, typically at or near the same site. The screens may be arranged in a series of levels, sometimes termed 'decks', such as 'upper deck' and 'lower deck'.

The action of the vibrating screening unit is usually of such 'heavy duty', that regular repair or replacement of the screen therein is required. Replacement of the screens is also sometimes required when the nature of the aggregate fed material changes, or different grades or types of discharge streams are required.

U.S. Pat. No. 6,698,594 B2 discloses a mobile screening machine with a frame on tracks, wherein a hopper and a main conveyor provide particulate to be screened into three grades of coarseness, with the coarsest falling into a shute, the middle coarseness falling onto one lateral conveyor, and the finest falling onto an underscreen conveyor which is driven downhill onto another lateral conveyor. U.S. Pat. No. 6,698,594 shows its underscreen conveyor as being mounted beneath its screening device in a substantially parallel relationship, so that material that falls on the underscreen conveyor is only conveyed downhill to its lower end. However, this fixed arrangement means that any repair or replacement work needed to or from underneath the screening device requires the complete detachment of the underscreen conveyor, with attendant downtime and cost required. This is especially to repair or replace screens in the 'lower deck' of a multi-decked screening unit.

SUMMARY OF THE INVENTION

It is an object of the present invention to provide an improved mobile aggregate processing plant.

According to one aspect of the present invention, there is provided a mobile aggregate processing plant for screening aggregate material comprising a mobile chassis, a vibrating screening unit mounted on the mobile chassis and able to provide at least one aggregate discharge stream there through, and an underscreen conveyor located wholly or substantially beneath the vibrating screening unit to wholly or substantially receive said at least one aggregate discharge stream, wherein the underscreen conveyor is driveable in an uphill direction so as to be able to discharge the aggregate discharge stream at a height higher than receiving the aggregate discharge stream, relative to the mobile chassis.

According to a second aspect of the present invention, there is provided a mobile aggregate processing plant for screening aggregate material comprising a mobile chassis, a vibrating screening unit mounted on the mobile chassis and able to provide at least one aggregate discharge stream therethrough, and an underscreen conveyor located wholly or substantially beneath the vibrating screening unit to wholly or substantially receive said at least one aggregate discharge stream, wherein the underscreen conveyor is moveable relative to the vibrating screening unit between a first position to work in co-operation with the vibrating screening unit in use, and at least a second position able to provide an access portal below the vibrating screen unit when not in use.

According to a third aspect of the present invention, there is provided a mobile aggregate processing plant for screening aggregate material comprising a mobile chassis, a vibrating screening unit mounted on the mobile chassis and able to provide at least one aggregate discharge stream therethrough, and an underscreen conveyor located wholly or substantially beneath the vibrating screening unit to wholly or substantially receive said at least one aggregate discharge stream, wherein the underscreen conveyor is driveable in an uphill direction so as to be able to discharge the aggregate discharge stream at a height higher than receiving the aggregate discharge stream, relative to the mobile chassis, and the underscreen conveyor is moveable relative to the vibrating screening unit between a first position to work in co-operation with the vibrating screening unit in use, and at least a second position able to provide an access portal below the vibrating screen unit when not in use Optionally, the underscreen conveyor is mounted on the mobile chassis independently of the mounting of the vibrating screening unit on the mobile chassis. For example, where the mobile chassis has a main frame and a sub-frame, the underscreen conveyor could be mounted on the main frame, and the vibrating screening could be mounted on the sub-frame.

Optionally, the underscreen conveyor is vertically moveable relative to the vibrating screening unit between the operating and non-operating configurations.

Optionally, the underscreen conveyor is laterally moveable relative to the vibrating screening unit between the operating and non-operating configurations.

Optionally, the underscreen conveyor is both vertically and laterally moveable relative to the vibrating screening unit between the operating and non-operating configurations.

Optionally, the vibrating screening unit comprises at least a series of upper screens and a series of lower screens, and a lower screen is removeable when the underscreen conveyor is in the non-operating configuration.

Optionally, the underscreen conveyor includes one or more wings to increase the aggregate discharge catchment area of the underscreen conveyor. The wings may be moveable relative to the conveyor belt, to increase the access portal.

Optionally, the mobile aggregate processing plant further comprises a post-screening discharge conveyor located at least partly beneath the vibrating screening unit to receive at least some of the aggregate discharge stream from the vibrating screening unit.

Optionally, the vibrating screening unit has an aggregate feed end or 'inlet end', and a discharge end or 'outlet end', and the aggregate feed end is higher than the discharge end relative to the mobile chassis.

In this way, the present invention also provides a mobile aggregate processing plant for screening aggregate material comprising a mobile chassis, a vibrating screening unit mounted on the mobile chassis and able to provide at least one aggregate discharge stream there through, and an underscreen conveyor located wholly or substantially beneath the vibrating screening unit to wholly or substantially receive said at least one aggregate discharge stream, wherein the underscreen conveyor is driveable in an uphill direction towards the discharge end of vibrating screen unit.

Optionally, the mobile aggregate processing plant further comprises one or more of the group comprising: an aggregate feed hopper, an aggregate feed conveyor, and one or more post-screening discharge conveyors.

Optionally, the mobile aggregate processing plant at least comprises:

a mobile chassis having tracked mobility;

an aggregate feed hopper to receive aggregate material;

an aggregate feed conveyor to transfer the aggregate material to a vibrating screening unit;

a vibrating screening unit having an aggregate feed end and an discharge end, the aggregate feed end being higher than the discharge end relative to the mobile chassis, and comprising at least two screens drivable to screen the aggregate material into at least two different aggregate discharge streams of different particle sizes, at least one of which is discharged directly through the vibrating screening unit;

an underscreen conveyor wholly or substantially located beneath the vibrating screening unit to receive the aggregate discharge stream discharged through the vibrating screening unit, and moveable relative to the vibrating screening unit between a first position to work in co-operation with the vibrating screening unit in use, and at least a second position able to provide an access portal below the vibrating screen unit when not in use; one or more post-screening discharge conveyors able to convey a discharge stream from the vibrating screening unit to a different location.

Optionally, the mobile aggregate processing plant has at least one post-screening discharge conveyor extending in a non-parallel direction to the mobile chassis and vibrating screening conveyor.

Optionally, the mobile aggregate processing plant has two or more post-screening discharge conveyors extending laterally to the mobile chassis and vibrating screening conveyor.

Optionally, the mobile aggregate processing plant is able to be located within an ISO high cube container.

According to another aspect of the present invention, there is provided a method of altering the size of a mobile aggregate processing plant for screening aggregate material comprising a mobile chassis, a vibrating screening unit mounted on the mobile chassis, and an underscreen conveyor at least partly located beneath the vibrating screening unit, comprising at least the steps of:

moving the underscreen conveyor between a first position to work in co-operation with the vibrating screening unit in use, and at least a second position able to provide an access portal below the vibrating screen unit when not in use; and accessing the vibrating screen unit from below.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

An embodiment of the present invention will now be described by way of example only, and with reference to the accompanying drawings in which.

DETAILED DESCRIPTION

Figure 1:
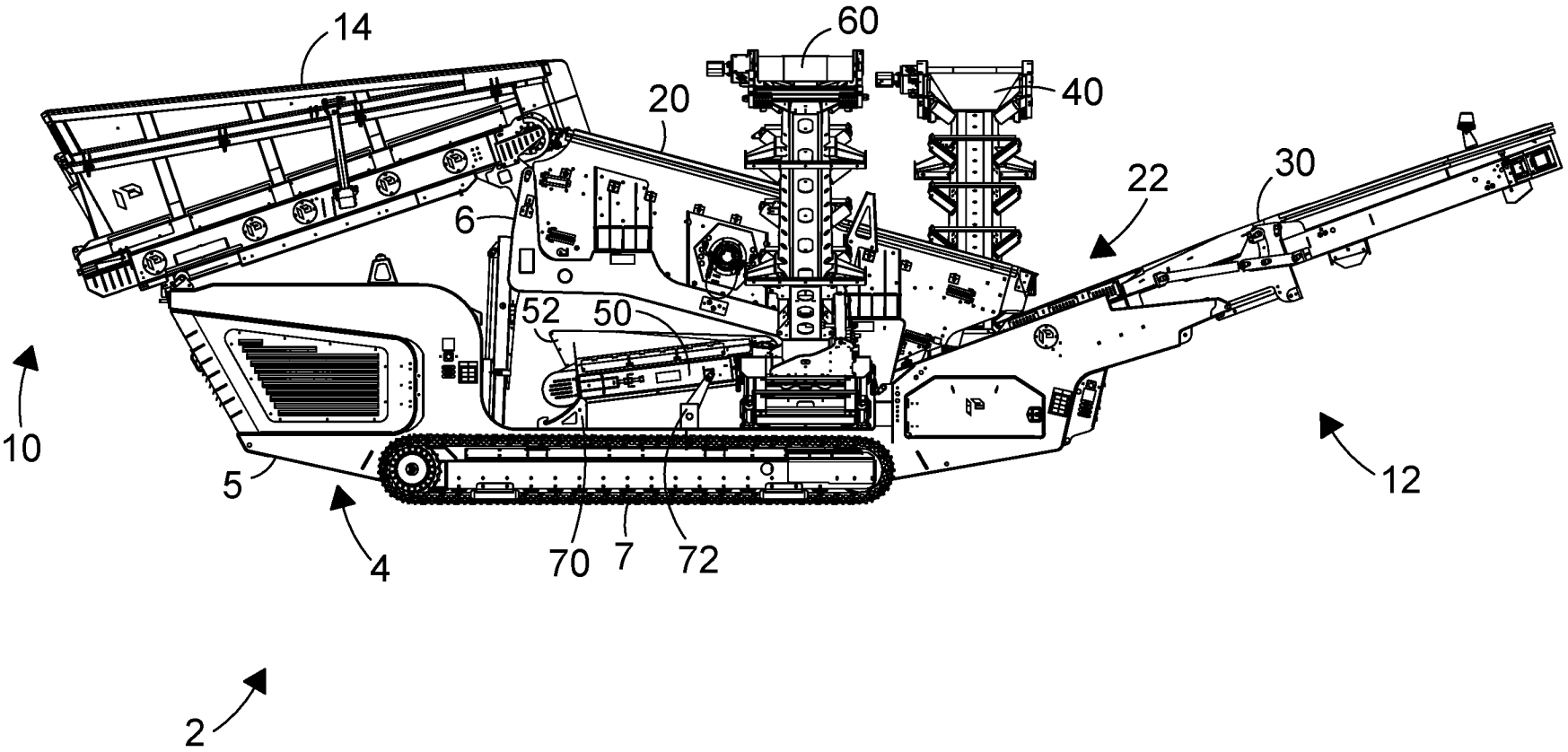
FIG. 1 is a side view of a mobile aggregate processing plant according to one embodiment of the present invention having an underscreen conveyor in a first position.

The present invention relates to a mobile aggregate processing plant for screening aggregate material. Mobile aggregate processing plants are well known in the art, and generally comprise a mobile chassis, which may be typically formed of a frame or framework, having an undercarriage, and typically a plurality of wheels on each side, optionally with a caterpillar-type track or tracking around the wheels in a manner known in the art. The action and ability of caterpillar tracks is well known in the art, and is not further discussed herein.

Optionally the plant may be self-mobile, usually within an area or range, such as within a working area or areas at which it is desired to process aggregate material, such as a demolition site or rock-processing site. Such mobility can be provided by a suitable motor on the mobile chassis.

Meanwhile, there are various 'transport' height restrictions in many countries, such as the UK and Germany, which can restrict the transport of larger mobile aggregate processing plants. There are well known height restrictions on many public roads, railways and other transport paths or links. Thus, being able to lower the overall height of the mobile aggregate processing plant of the present invention may allow a large mobile aggregate processing plant to meet such transport height restrictions, and/or significantly reduce the requirement for any special permits or conditions. In this way, being able to reduce the overall height of larger sized mobile aggregate processing plants may lead to more convenient transportation of the plant from place to place.

Transport containers, such as shipping or haulage or road containers, are also well known in the art, and typically have a number of known and regular dimensions, to provide compatibility with the means of transport, such as trucks and/or transport vessels including ships. One well known form of transport container is the 'ISO 40 foot' container, whose general internal dimensions are approximately 12 m in length, between 2.3 and 2.4 m in width, and 2.4 m in height. As the ISO 40 foot container is so well known and used, the costs of shipping an ISO 40 foot is now a virtually worldwide standard cost, compared to the cost of shipping a bespoke piece of machinery.

Also well known in the art are ISO 40 'high cube' containers, typically having the same length and width as the standard ISO 40 foot container, but having a higher height of 2.7 m with a door aperture height of up to 2.6 m, typically close to 2.6 m.

In a particular embodiment of the present invention, the mobile aggregate processing plant of the present invention can be located within an ISO 40 foot container, or an ISO high cube container, in a transport configuration, as discussed hereinafter.

In an alternative, the mobile aggregate processing plant may be able to be towed on a public highway by a large vehicle, or towed on a suitable trailer, wherein being able to reduce the overall height of the mobile aggregate processing plant can also allow larger sized mobile aggregate processing plants to be more conveniently transported from place to place.

The plant of the present invention includes a mobile chassis typically being an elongate frame able to support most or all of the other components or features of the mobile aggregate processing plant. Optionally, the mobile chassis includes one or more sub-frames. In one view, the mobile chassis has an elongate arrangement, with one end generally being for the provision of aggregate feed material to be screened, sometimes termed an 'aggregate feed end' or 'inlet end', and an opposing end generally being for the location of one or more discharges of screened material, sometimes also termed a 'discharge end'.

At the aggregate feed end, the present invention may include an aggregate feed hopper designed or configured to receive a feed or other supply of aggregate material, which may be provided by any suitable supply means. The hopper is typically designed to direct the aggregate feed towards an aggregate feed conveyor located at the bottom of the hopper, and typically having a conveyor belt able to convey the aggregate feed towards a discharge end of the conveyor belt, which discharge end is able to transfer the feed aggregate into and/or onto one end of a vibrating screening unit. Optionally, the aggregate feed conveyor is inclined, typically in an uphill direction towards its discharge end.

Vibrating screening units are well known in the art, and typically comprise a plurality of screens having openings of defined dimensions. Optionally, the vibrating screening unit has screens having openings of two or more different sizes. Further optionally, the vibrating screening unit has multiple layers or 'decks' of screens, including 'half decks'. A typical configuration comprises an 'upper deck' of screen or screens, and a 'lower deck' screen or screens.

The skilled man is aware of many arrangements possible and available for locating various screens within a vibrating screening unit. One typical arrangement comprises a series of upper screens having openings of one size, and a series of lower screens having openings of a different size, typically of a smaller size than the openings of the upper screen.

The screens are typically vibrated by the use of one or more motors, sometimes providing eccentric motion, and able to move at least one part of each screen relative to another part, to create motion of the screens and hence to help 'screen' or separate the mixed aggregate feed material into at least two different particle sizes or 'grades', optionally more than two different particle sizes, some of which can pass through at least one screen, optionally both or all screens, and some of which cannot.

To assist the separating action, the vibrating screening unit is inclined from its upper inlet end receiving the aggregate feed material from the aggregate feed conveyor, downwardly towards its discharge or outlet end, from where there can be one or more discharges of at least one grade of aggregate discharge stream. The downward inclination of the vibrating screening unit uses gravity to provide at least some of the movement of the aggregate material along the vibrating screening unit, and so helps a continuous screening action to occur along the length of the vibrating screening unit.

At the outlet end of the vibrating screening unit, there may be one or more post-screening discharge conveyors, able to convey a particular grade or coarseness of screened material as a discharge stream from the vibrating screening unit to a different location. One discharge stream may be that portion of the feed aggregate material that is unable to pass through every screen of the vibrating screening unit, i.e. which typically passes across the top of all screens and is discharged as the coarsest grade or an 'uppermost' stream, typically comprising the largest or coarsest particle size or sizes of the aggregate feed material.

Where the vibrating screening unit may comprise at least two decks of screens having different sized openings, there can be provided at least one, optionally more, intermediate grade or coarseness of screened material, comprising that portion of the feed aggregate material that can pass through an upper deck, but not through a lower deck of screens. Such a discharge stream(s) could be provided to a collecting end of a post-screening discharge conveyor, for conveying to a discharge end thereof and into a separate container or to form a separate pile.

The skilled man can see that there could be a number of grades of discharge streams from the end of the vibrating screen unit, depending upon the number and type of screens therein, each of which could provide a separate grade of discharge stream, for separate conveying to a separate container or pile.

The skilled man can also see that one or more of the post-screening discharge conveyors may be arranged to be at the same or a different longitudinal direction as the vibrating screen unit. In one example, there can be one post-screening discharge conveyor having the same longitudinal direction as the vibrating screening unit, and one or more post-screening discharge conveyors being at an angle thereto, including at a 90° angle, i.e. lateral to the longitudinal direction of the vibrating screen unit, and typically lateral to the mobile aggregate processing plant.

In the present invention, an underscreen conveyor is wholly or substantially located beneath the vibrating screening unit. The underscreen conveyor is located to receive an aggregate discharge stream which is able to pass down through the vibrating screening unit before reaching the outlet end of the vibrating screening unit from which larger grades of material are discharged. Such an aggregate discharge stream generally comprises that portion of the aggregate feed material that is sized to be less than all screens in the vibrating screening unit, sometimes termed the 'fines', being the finest discharge material, and such material discharges downwardly through the screens of the vibrating screening unit prior to reaching the outlet end of the vibrating screening unit.

Conventionally, and as shown in U.S. Pat. No. 6,698,594 B2, such fine material is received by an underscreen conveyor which is mounted to the vibrating screening unit, or at least that part of a frame or framework supporting the vibrating screening unit, and is parallel thereto, such that the conventional underscreen conveyor passes such material downwardly towards a post-screening discharge conveyor.

According to one embodiment of the present invention, the underscreen conveyor is driveable in a uphill direction relative to the outlet end of the vibrating screening unit, i.e. so as to be able to discharge the aggregate discharge stream it receives directly through the vibrating screening unit to or at a height higher than the height of the aggregate discharge stream as received, relative to the mobile chassis.

The juxtaposition of the underscreen conveyor relative the vibrating screening unit that can achieve the underscreen conveyor being driveable in a uphill direction relative to the outlet end of the vibrating screening unit increases the possible access portal thereinbetween, and can reduce the potential for blockage of the vibrating screening unit when the underscreen conveyor is located too close to the underscreen discharge from the vibrating screening unit.

Alternatively and/or additionally, the underscreen conveyor of the present invention is moveable relative to the vibrating screening unit between a first position to work in co-operation with the vibrating screening unit in use, and at least a second position able to provide an access portal below the vibrating screen unit when not in use.

The first position may be considered as an 'operating configuration', wherein the underscreen conveyor is able to wholly or substantially receive the at least one aggregate discharge stream passing directly through the vibrating screening unit, and to discharge said stream, optionally in an uphill direction, to its discharge end.

The second position may be considered as a 'non-operating configuration', wherein the underscreen conveyor is not designed to co-operate with vibrating screening unit in use.

The vibrating screening unit may be moveable to more than the first and second positions.

The underscreen conveyor may include one or more upwardly and/or outwardly extending wings, so as to increase its catchment or target area for screened or discharged material, optionally in the form of a hopper or hopper-like arrangement.

Movement of wings may increase the size or access to the access portal below the vibrating screen unit when not the plant is in use. Thus, such wings may be separate from each other. Such wings may alternatively or additionally be separable from the remainder of the underscreen conveyor. Such wings may also alternatively or additionally be moveable from an in-use operating position, to a non-operating position.

The underscreen conveyor of the present invention may include one or more conveyor belts, typically one conveyor belt driven from at least one end, typically in a forward motion to convey a received discharge stream to a discharge end.

Optionally, the discharge end of the underscreen conveyor is able to discharge received material onto a post-screening discharge conveyor, which post-screening discharge conveyor may be in line with, or at an angle to, or lateral to, the longitudinal direction of the mobile chassis and/or the vibrating screening unit.

Optionally, the post-screening discharge conveyor is located at least partly beneath the vibrating screening unit to receive at least some of the aggregate discharge stream from the vibrating screening unit. In this way, underscreen conveyor does not need to have a catchment area that extends the full extent or length of the discharge below the vibrating screening unit.

The underscreen conveyor may be supported on the mobile chassis using one or more supports, typically including at least one or more legs or struts, optionally extendable legs or struts, and/or including the use of one or more actuators or other ram and piston arrangements, whose movement or activation is able to move the position of the underscreen conveyor relative to the vibrating screening unit and/or the mobile chassis. Such movement may be in at least a vertical direction relative to the vertical screening unit, or in a lateral direction relative to the vertical screening unit, or both.

Movement of the underscreen conveyor away from the vibrating screening unit provides an access portal below the vibrating screen unit when not in use, in particular accessibility by repair or service personnel to the bottom or the lower parts and/or underneath of the vibrating screening unit. Such access has dramatic benefit during the maintenance and/or repair and/or replacement work required to maintain the vibrating screening unit, or change the screens for another reason.

In particular, screens used in a vibrating screening unit can 'wear out' and/or break, typically regularly and without warning. It is expected during the normal operation of a mobile aggregate processing plant for screening aggregate material to replace the screens of a vibrating screening unit regularly. Where such screens are accessible from an upper position on or over the vibrating screening unit, such replacement may be a relatively fast and simple exercise. Where such screens are located in a lower part or deck or otherwise underneath the vibrating screening unit, such access is not possible where the underscreen conveyor is deliberately located close to, in particular parallel with, the vibrating screening unit, and/or where the underscreen conveyor has no movement relative thereto without dismantling the plant.

Movement of the underscreen conveyor in the present invention relative to the vibrating screening unit provides such increased access, and so significantly reduces the effort to replace worn out or broken lower or lowermost screens.

Movement of the underscreen conveyor in the present invention relative to the vibrating screening unit also allows the vibrating screening unit to be moved or be moveable, which may allow the overall height of the mobile aggregate processing plant to be reduced where other components of the plant are moveable and/or removable, thereby possibly making more convenient transportation of the mobile aggregate processing plant in a manner described hereinbefore.

In particular, reducing the overall height of the mobile aggregate processing plant may allow the mobile aggregate processing plant to be located within an ISO high cube container, which achieves very convenient transportation of the mobile aggregate processing plant, either by road, rail or sea, in particular for significant transportation over a substantial distance.

Figure 2:
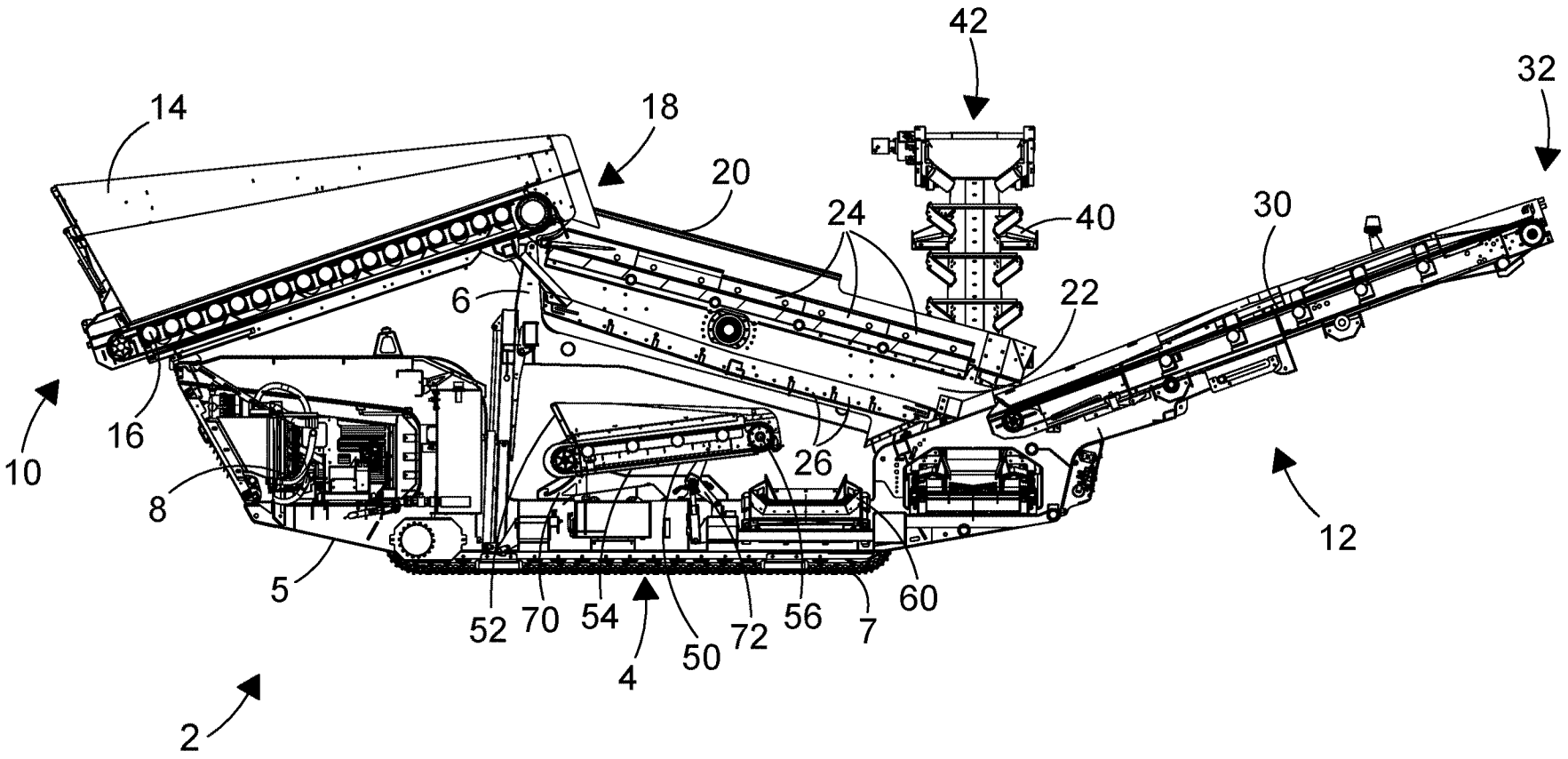
FIG. 2 is a cross-sectional view of FIG. 1.

With reference to FIGS. 1 and 2, there is shown a mobile aggregate processing plant 2 for screening a mixed grade aggregate feed material (not shown). The plant 2 comprises a mobile chassis 4, comprising at least a main frame 5 and a sub-frame 6. The mobile chassis 4 has caterpillar tracks 7 to provide its mobility, at least within a location or range, and an engine 8. The sub-frame 6 supports a vibrating screening unit 20 discussed hereinafter, and the main frame 5 is able to support essentially all the other components of the mobile aggregate processing plant. The main frame 5 and sub-frame 6 may be integrally formed, or relatively moveable.

Generally, the mobile chassis 4 has an elongate arrangement, able in this way to define one end being a 'hopper end' 10 for the provision of aggregate material to be screened, and a discharge end 12, wherein one or more grades of discharge material, generally in the form of discharge streams, can be discharged, typically towards distinct or separate locations or for further conveyance means or mechanisms such as containers or trucks or trailers.

The hopper end 10 includes an aggregate feed hopper 14 known in the art, and able to create an enlarged opening above an aggregate feed conveyor 16, and so direct aggregate feed material that is provided into the hopper 14 down towards the conveyor belt of the aggregate feed conveyor 16. The aggregate feed conveyor 16 conveys the feed aggregate material from a generally lower end, upwardly towards a discharge end 18, and into a receiving or inlet end of a vibrating screening unit 20. The vibrating screening unit 20 is inclined downwardly from the inlet end to a discharge or outlet end 22, which incline allows gravity to assist the movement of the mixed aggregate feed material along the length of the vibrating screening unit 20 in a manner known in the art.

The vibrating screening unit 20 comprises an upper deck of upper screens 24 having openings of a first size, and a lower deck of lower screens 26 having openings of a smaller size than the openings in the upper screens 24.

The motion, action and effect of a vibrating screening unit 20 is known in the art, often involving eccentric motion, and possibly based on using eccentric weights, which are able to move, in particular vibrate, optionally vibrate rapidly, the screens 24, 26, causing the mixed aggregate feed material to separate, and allowing that material which is able to pass through all the openings in the screens 24, 26, the 'fines', to pass downwardly therethrough.

As is known in the art, that portion or grade of the aggregate feed material that cannot pass through even the largest screen openings, being those of the upper screens 24 in the example shown in FIG. 1, provides a 'most coarse' grade of discharge material having the largest average particle size, diameter or other dimension. This material is provided as one discharge stream to the top of the discharge end 22 of the vibrating screening unit 20 and onto a first post-screening discharge conveyor 30. The first such conveyor 30 may be in line with the vibrating screening unit 20, and has a discharge end 32 able to provide its discharge stream to a first location or to a first container or the like.

That portion or grade of the aggregate feed material that can pass through the openings in the upper screens 24 but not through the smaller openings of the lower screens 26, can be provided as a second grade of material, and as a discharge stream onto a second post-screening discharge conveyor 40, to be conveyed therealong to a second discharge end 42 to a separate location or separate container, etc. The example of the present invention shown in FIGS. 1 and 2 shows the second conveyor 40 being in a lateral direction to the general direction of the vibrating screening unit 20 and the first discharge conveyor 32.

FIGS. 1 and 2 also shows an underscreen conveyor 50 wholly or substantially located beneath the vibrating screening unit 20. The underscreen conveyor 50 comprises a hopper surround 52, and a conveyor 54, and a discharge end 56. The hopper surround 52 may be formed from a series of separable or moveable wings on three sides to form a hopper arrangement so as to increase the discharge catchment area of the underscreen conveyor 50

The underscreen conveyor 50 is able to receive that portion of the feed aggregate material able to pass through all the openings in the upper screens 24 and the lower screens 26, and thus pass directly down through the vibrating screening unit 20 to fall beneath it. Such portion can be gathered by the hopper arrangement 52, and conveyed by the conveyor 54 in a forward and uphill motion towards its discharge end 56, and onto a third post-screening discharge conveyor 60, shown in FIGS. 1 and 2 to be extending horizontally and laterally outwardly from the general longitudinal direction of the vibrating screening unit 20 and the first conveyor 30.

The underscreen conveyor 50 is supported at one end by a first leg framework 70, and towards its discharge end 56 by a second leg framework 72. The first and second leg frameworks 70, 72 are moveable, generally by the action of one or more actuators or ram and piston arrangements, so as to be able to move the underscreen conveyor 50 from an operational configuration as shown in FIGS. 1 and 2, able to cooperate in use with the vibrating screening unit 20 and receive a discharge stream therefrom which passes directly therethrough, and a second or non-operational position, as shown in FIG. 3.

Figure 3:
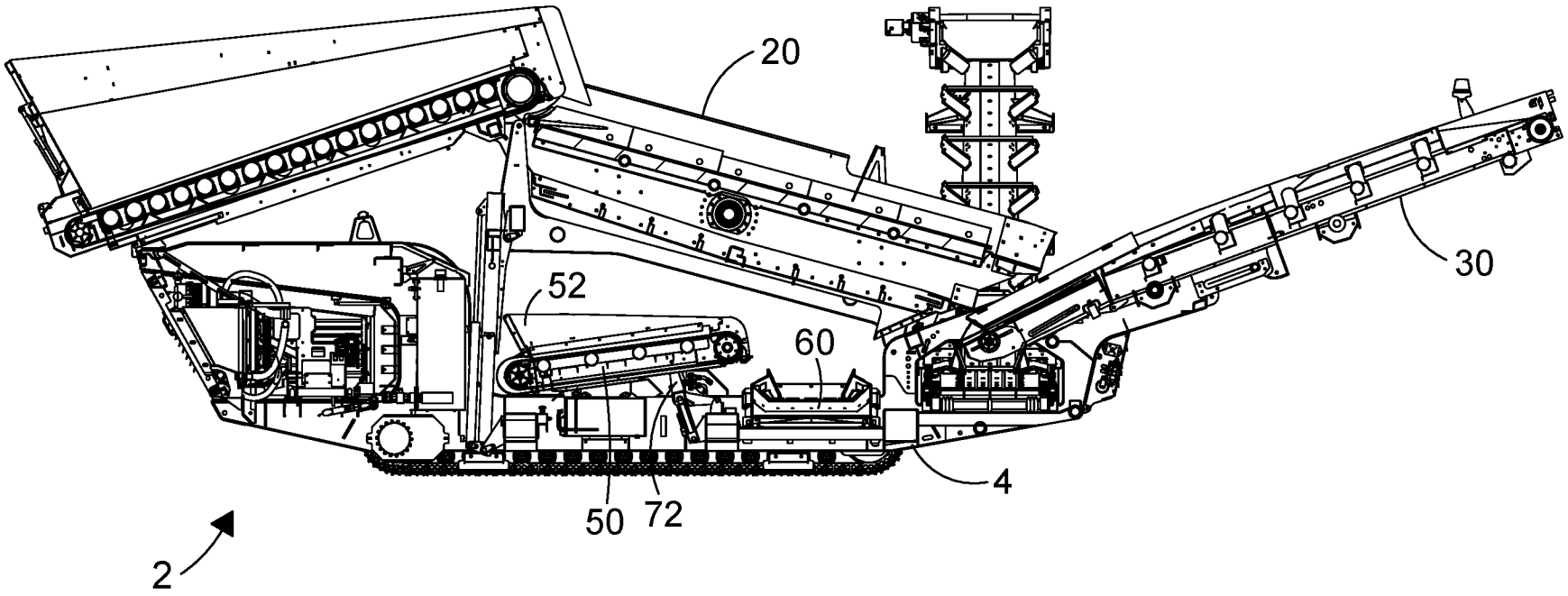
FIG. 3 is a cross-sectional view of FIG. 1, with the underscreen conveyor in a second configuration.

FIG. 3 shows the increased access portal between the underscreen conveyor 50 in its second configuration, and the lower portion or parts of the vibrating screening unit 20, to allow a user to access and work on the lower parts or underneath of the vibrating screening unit 20, in particular to replace lower screens 26 when they are either worn out or otherwise broken.

The present invention provides a mobile aggregate processing plant able to include an underscreen conveyor which is either moveable relative to the vibrating screening unit, or able to be forwardly driveable in an uphill direction, or both, and thereby provide advantages both in processing of discharge material from the vibrating screening unit, and reduction of the overall height of the mobile aggregate processing unit for transportation.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

The invention claimed is:

1. A mobile aggregate processing plant for screening aggregate material comprising a mobile chassis, a vibrating screening unit mounted on the mobile chassis and able to provide at least one aggregate discharge stream therethrough, and an underscreen conveyor located wholly or substantially beneath the vibrating screening unit to wholly or substantially receive said at least one aggregate discharge stream, wherein the underscreen conveyor is mounted to the mobile chassis so as to be moveable relative to the vibrating screening unit between a first position in use to work in co-operation with the vibrating screening unit, and at least a second position when not in use to provide an access portal below the vibrating screen unit, wherein in the first position the underscreen conveyor is positioned closer to the vibrating screen unit than in the second position, wherein the underscreen conveyor has a first end and a second end, the first end being located at a lower vertical position relative to the mobile chassis than the second end so as to, when the underscreen conveyor is in the first position during use, convey aggregate material on the underscreen conveyor in an uphill direction from the first end to the second end in order to discharge the aggregate discharge stream at a vertical height above the mobile chassis that is higher at the second end than where the aggregate discharge stream is received on the underscreen conveyor, and wherein the vibrating screening unit is driveable in the same longitudinal direction relative to the mobile chassis as the underscreen conveyor.

2. The mobile aggregate processing plant as claimed in claim 1, wherein the underscreen conveyor is mounted on the mobile chassis independently of the mounting of the vibrating screening unit on the mobile chassis.

3. The mobile aggregate processing plant as claimed in claim 1, wherein the mobile chassis has a main frame and a sub-frame, and the underscreen conveyor is mounted on the main frame, and the vibrating screening is mounted on the sub-frame.

4. The mobile aggregate processing plant as claimed in claim 1, wherein the underscreen conveyor is vertically moveable relative to the vibrating screening unit between the operating and non-operating configurations.

5. The mobile aggregate processing plant as claimed in claim 1, wherein the underscreen conveyor is laterally moveable relative to the vibrating screening unit between the operating and non-operating configurations.

6. The mobile aggregate processing plant as claimed in claim 3 wherein the vibrating screening unit comprises at least a series of upper screens and a series of lower screens, and a lower screen is removeable when the underscreen conveyor is in the second position.

7. The mobile aggregate processing plant as claimed in claim 1, wherein the underscreen conveyor includes one or more wings to increase the aggregate discharge catchment area of the underscreen conveyor.

8. The mobile aggregate processing plant as claimed in claim 1, further comprising a post-screening discharge conveyor located at least partly beneath the vibrating screening unit to receive at least some of the aggregate discharge stream from the vibrating screening unit.

9. The mobile aggregate processing plant as claimed in claim 1, further comprising one or more of the group comprising: an aggregate feed hopper, an aggregate feed conveyor, one or more post-screening discharge conveyors.

10. A mobile aggregate processing plant comprising:

a mobile chassis having tracked mobility;

an aggregate feed hopper to receive aggregate material;

an aggregate feed conveyor to transfer the aggregate material to a vibrating screening unit;

a vibrating screening unit having an aggregate feed end and a discharge end, the aggregate feed end being higher than the discharge end relative to the mobile chassis, and comprising at least two screens drivable to screen the aggregate material into at least two different aggregate discharge streams of different particle sizes, at least one of which is discharged directly through the vibrating screening unit;

an underscreen conveyor wholly or substantially located beneath the vibrating screening unit to receive the aggregate discharge stream discharged through the vibrating screening unit;

one or more post-screening discharge conveyors able to convey a discharge stream from the vibrating screening unit to a different location;

wherein the underscreen conveyor is mounted to the mobile chassis so as to be moveable relative to the vibrating screening unit between a first position in use to work in co-operation with the vibrating screening unit, and at least a second position when not in use to provide an access portal below the vibrating screen unit, wherein in the first position the underscreen conveyor is positioned closer to the vibrating screen unit than in the second position, wherein the underscreen conveyor has a first end and a second end, the first end being located at a lower vertical position relative to the mobile chassis than the second end so as to, when the underscreen conveyor is in the first position during use, convey aggregate material on the underscreen conveyor in an uphill angle relative to the mobile chassis from the first end to the second end in order to discharge the aggregate discharge stream at a vertical height above the mobile chassis that is higher at the second end than where the aggregate discharge stream is received on the underscreen conveyor.

11. The mobile aggregate processing plant as claimed in claim 10 having either at least one post-screening discharge conveyor extending in a non-parallel direction to the mobile chassis and vibrating screening conveyor, or one or two post-screening discharge conveyors extending laterally to the mobile chassis and vibrating screening conveyor, or both.

12. The mobile aggregate processing plant as claimed in claim 1, able to be located within an ISO high cube container.

13. A method of servicing a mobile aggregate processing plant for screening aggregate material comprising the steps of:

providing a mobile chassis, a vibrating screening unit mounted on the mobile chassis, and an underscreen conveyor at least partly located beneath the vibrating screening unit, wherein the underscreen conveyor is mounted to the mobile chassis so as to be moveable relative to the vibrating screening unit between a first position and at least a second position, wherein in the first position the underscreen conveyor is positioned closer to the vibrating screen unit than in the second position;

moving the underscreen conveyor between a first position to work in cooperation with the vibrating screening unit in use, and at least a second position able to provide an access portal below the vibrating screen unit when not in use; and accessing the vibrating screen unit from below.

14. The mobile aggregate processing plant as claimed in claim 1, wherein the vibrating screening unit has an aggregate feed end positioned to receive a stream of aggregate material, and a discharge end for discharging aggregate material that has not passed through the vibrating screening unit, and wherein when the underscreen conveyor is in the first position, the spacing between the discharge end of the vibrating screening unit and the second end of the underscreen conveyor is less than the spacing between the aggregate feed end of the vibrating screening unit and the first end of the underscreen conveyor.

* * * * *